United States Patent [19]

Formosa

[11] Patent Number: 4,649,896

[45] Date of Patent: Mar. 17, 1987

[54] DEVICE FOR STOPPING AIR LEAKAGE THROUGH FIREPLACE FLUES

[76] Inventor: David J. Formosa, 4787 Bowness Avenue, Powell River, British Columbia, Canada, V8A 3S4

[21] Appl. No.: 763,640

[22] Filed: Aug. 8, 1985

[51] Int. Cl.[4] ..... F23J 13/08

[52] U.S. Cl. ..... 126/319; 126/120

[58] Field of Search ..... 126/120, 126, 319, 138, 126/139, 142; 98/59; 138/93; 223/67; 410/119, 129; 441/90, 91, 92, 40, 41, 42; 49/477; 297/DIG. 3; 5/449, 450, 451, 457

[56] References Cited

U.S. PATENT DOCUMENTS

| | | | |
|---|---|---|---|
| 2,625,209 | 1/1953 | Harrison et al. | 297/DIG. 3 X |
| 2,842,783 | 7/1958 | Druck | 5/457 |
| 3,112,956 | 12/1963 | Schick et al. | 297/DIG. 3 |
| 3,232,207 | 2/1966 | Gibbons | 98/59 |
| 3,253,861 | 5/1966 | Howard | 297/DIG. 3 X |
| 3,554,135 | 1/1971 | Duvall | 410/119 |
| 3,781,933 | 1/1974 | Soter | 441/40 |
| 4,194,494 | 3/1980 | Wagner | 126/319 |

FOREIGN PATENT DOCUMENTS

| | | | |
|---|---|---|---|
| 2718838 | 11/1978 | Fed. Rep. of Germany | 441/40 |
| 396592 | 8/1933 | United Kingdom | 5/457 |
| 788338 | 12/1957 | United Kingdom | 441/40 |
| 1571522 | 7/1980 | United Kingdom | 126/319 |

*Primary Examiner*—Carroll B. Dority, Jr.
*Attorney, Agent, or Firm*—Carver & Co.

[57] ABSTRACT

A device for stopping air leakage through fireplace flues includes an inflatable bag-like member having a top and a bottom of a flexible, air impermeable material. The top and the bottom are sealed together about an outer periphery of the member for retaining pressurized air therebetween. The member has a plurality of selectively slitable sealed areas for permitting a damper handle to pass through one of the areas. The top and the bottom are sealed together about each of the areas. A closable conduit communicates with the member for admitting pressurized air into the member.

7 Claims, 6 Drawing Figures

DEVICE FOR STOPPING AIR LEAKAGE THROUGH FIREPLACE FLUES

BACKGROUND OF THE INVENTION

This invention relates to an inflatable device for stopping air leakage through fireplace flues. Studies have shown that considerable air leakage occurs through fireplace flues either through the infiltration of cold air moving downwardly through the flue or through warm air moving upwardly. In cold weather this leads to high energy losses. Studies have indicated that normal dampers, even when closed, do not affect the amount of air leakage. This problem has been recognised and conventional advice dictates the use of fibreglass insulation to be stuffed about the damper. It is difficult to assure proper sealing in this manner and, in addition, it is easy to forget that the fibreglass is in place when a fire is started. The problem has been recognised and some devices have been developed to seal the flue. An example of such a device is the fireplace plug found in U.S. Pat. No. 4,194,494 to Wagner. However, this is a special device adapted only for one type of free-standing fireplace and is not for general application in most fireplaces.

Inflatable devices for sealing conduits and the like have been developed in the past. For example, U.S. Pat. No. 3,990,464 to Jenkins shows a balloon-like device for sealing a heating duct. Similarly, U.S. Pat. No. 4,160,464 to Ballinger shows an inflatable member for insertion into a bore of a pipe, while U.S. Pat. No. 3,232,207 shows a balloon closure for an industrial stack.

The prior art has not revealed a convenient inflatable device suitable for sealing the flue of a fireplace which must accommodate the damper handle normally extending downwardly from the damper.

SUMMARY OF THE INVENTION

According to the invention, a device for stopping air leakage through fireplace flues includes an inflatable bag-like member having a top and a bottom of a flexible, air impermeable material. The top and the bottom are sealed together about an outer periphery of the member for retaining pressurised air therebetween. The member has a plurality of selectively slitable sealed areas for permitting a damper handle to pass through one of the areas. The top and the bottom are sealed together about each of the areas. A closable conduit communicates with the member for admitting pressurized air into the member.

Preferably the member is substantially rectangular with a front, a back and opposite ends, each having at least one U-shaped sealed area to accommodate compression of the device when received in the top of a fireplace. The top and the bottom of the member are sealed together across the U-shaped areas.

DESCRIPTION OF THE PREFERRED EMBODIMENT

Figure 1:
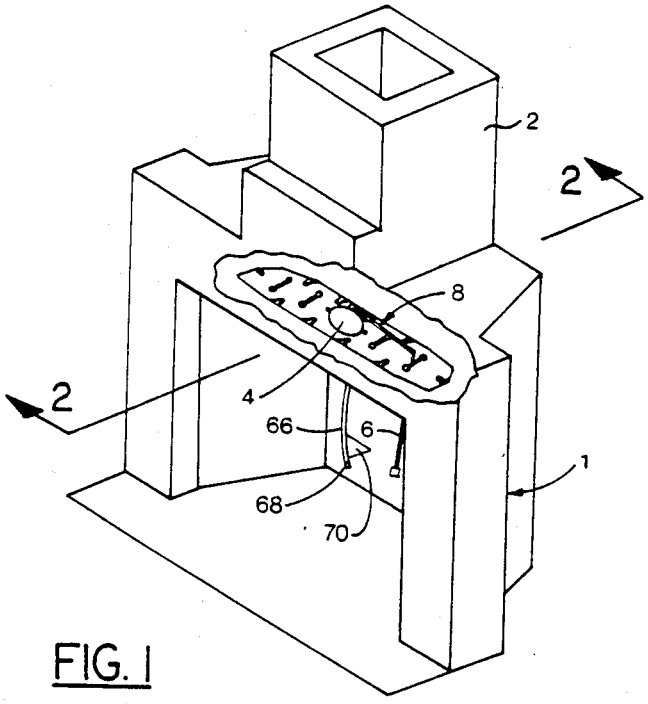
FIG. 1 is a perspective view of a fireplace showing a device according to the invention for stopping air leakage through the fireplace.
Figure 2:
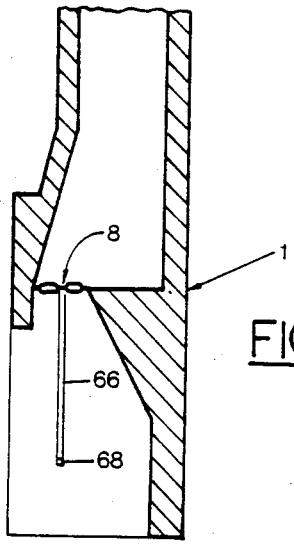
FIG. 2 is a sectional view along line 2—2 of FIG. 1.
Figure 3:
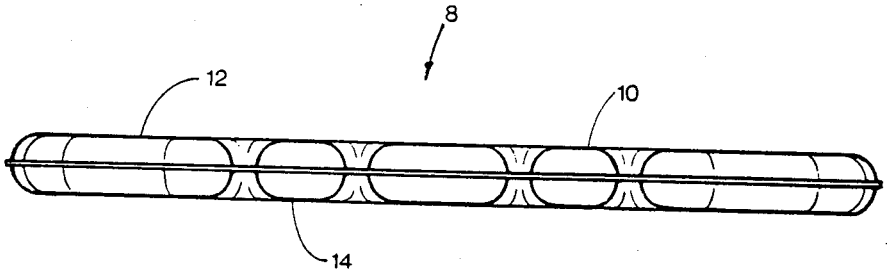
FIG. 3 is a front elevation of the device when inflated.

Referring to the drawings, FIG. 1 is a perspective view of a fireplace 1 having a flue 2. A damper 4 is fitted near the bottom of the flue and has a damper handle 6. The invention provides a device 8 for stopping air leakage through the flue of the fireplace. The device is compressively received at the top of the fireplace adjacent the flue. The device 8 is shown in better detail in FIGS. 3 and 4.

The device 8 has an inflatable bag-like member 10 having a top 12 and a bottom 14. Each of these is made of a flexible, air impermeable material such as polyvinyl chloride (vinyl). The material used for waterbeds is suitable. The device has an outer periphery 16 where the top and bottom are sealed together to retain pressurised air therebetween. It may be observed from FIG. 4 that the member is substantially rectangular, having a front 18, a back 20, and opposite ends 22 and 24. The front has tapering portions 26 and 28 adjacent ends 22 and 24, while the back 20 has similar tapering portions 30 and 32. The front and back therefore taper towards each other adjacent the ends. The ends 22 and 24 also have tapering portions 34 and 36 near the back 20 such that the ends taper towards the back of the member. This shape was developed empirically to fit most fireplaces. The overall size, when deflated, is such that the front 18 is approximately 41 inches, while the front and back are spaced-apart 17 inches at the midpoint of each.

Figure 4:
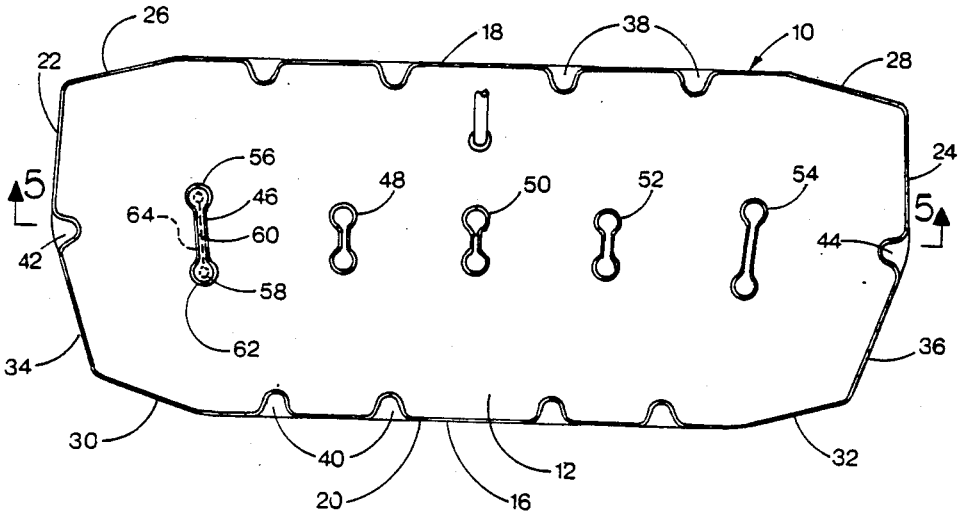
FIG. 4 is a top plan view thereof when deflated.
Figure 5:
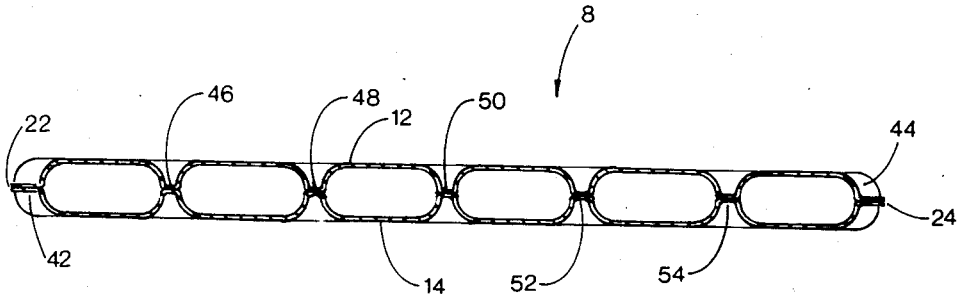
FIG. 5 is a sectional view thereof when inflated taken along line 5—5 of FIG. 4.
Figure 6:
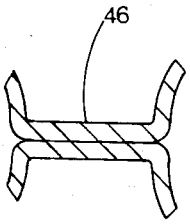
FIG. 6 is a simplified, fragmented section showing a typical slitable area prior to slitting.

It may be observed from FIG. 4 that the front has a plurality of U-shaped areas 38 spaced-apart thereon. Similarly, the back has a plurality of similar U-shaped areas 40, while the ends have one such area 42 and 44 each. These U-shaped areas allow for compression or defamation of the device to accommodate fireplaces which are smaller than the full dimensions of the inflated device. The areas 38 and 40 accommodate fireplaces having spaces at the top smaller than the top and back of the inflated member, while the areas 42 and 44 accommodate fireplaces having openings at the top narrower than the distance between the front and back of the inflated device. The recesses tend to fold as the members compress to fill the space. The top and bottom are sealed together completely across these U-shaped areas so they don't inflate and easily fold.

The member has a plurality of selectively slitable, sealed areas 46, 48, 50, 52 and 54 for permitting damper handle 6 to pass through one of the areas. The areas are spaced-apart to accommodate damper handles of different locations for different fireplaces. The areas are all sealed when the device is supplied to the consumer, but are slitable by the consumer according to the position of the damper handle on his fireplace. The areas are all similar in shape although the areas 46 and 54 nearer the ends of the member are slightly longer. This has been found to be desirable to accommodate certain damper handles. Referring to area 46, each of the areas has generally round portions 56 and 58 at each end joined by a narrower elongated portion 60. The top and bottom 14 of the member are sealed together about a periphery 62 of each of the areas. A slit 64 is illustrated in area 46 on the assumption that this is the location of the damper handle. Preferably the ends of the slit are rounded to resist further tearing. In the preferred embodiment the top and bottom of the member are sealed together completely across the slitable areas. In use, if the fireplace has a damper handle as shown, the user first ascertains the one of the slitable areas 46 to 54 closest to the damper handle. This is slit. No slit is made if a dample handle needn't pass through the device. The device is inflated through an elongated conduit 66 which communicates with the member 10. After the member is inflated, a plug 68 is fitted to the conduit to prevent escape of pressurised air from the member. Alternatively, a one-way valve can be fitted to the conduit, preferably adjacent number 10. A flag or similar indicia 70, shown in FIG. 1, is fitted to the end of the conduit to warn that the device is in place in case a fire is to be lit.

The user pushes the device upwardly with the damper handle extending through the slit until the device is fitted tightly at the top of the fireplace adjacent the flue. Additional air can be added through conduit 66 if necessary to provide a tight seal.

What is claimed is:

1. In combination:

a fireplace having a flue and a damper handle; and a fireplace flue sealing device having an inflatable bag-like member with a top and a bottom of a flexible, air impermeable material, the top and the bottom being sealed together about an outer periphery of the member for retaining pressurized air therebetween, the member having a plurality of selectively slittable sealed areas for permitting the damper handle to pass through a selected one of said areas, the top and the bottom being sealed together about each of the areas, the member being sized and shaped to sealingly engage the fireplace below the flue thereof when inflated; and a closable conduit communicating with the member for admitting pressurized air into the member.

2. A combination as claimed in claim 1, wherein the member is substantially rectangular with a front, a back and opposite ends, each having at least one inwardly extending U-shaped sealed area to accommodate compression of the device when received in the fireplace below the flue thereof, the top and bottom of the member being sealed together about the at least one U-shaped area.

3. A combination as claimed in claim 2, wherein the front and the back each have a plurality of spaced-apart said U-shaped areas.

4. A device as claimed in claim 2, wherein the front and back taper towards each other at each end of the member and wherein the ends taper towards each other at the back of the member.

5. A combination as claimed in claim 1, wherein each of the areas has two round end portions joined by a narrow elongated portion.

6. A combination as claimed in claim 4, wherein the front is generally 41 inches long and the front and the back are generally 17 inches apart.

7. A combination as claimed in claim 1, wherein the conduit includes an elongated hose having warning indicia thereon.

* * * * *